US005691291A

United States Patent [19]

Wierenga et al.

[11] Patent Number: 5,691,291

[45] Date of Patent: Nov. 25, 1997

[54] HARD SURFACE CLEANING COMPOSITIONS COMPRISING PROTONATED AMINES AND AMINE OXIDE SURFACTANTS

[75] Inventors: Thomas James Wierenga, Cincinnati; Bruce Barger, West Chester, both of Ohio

[73] Assignee: The Procter & Gamble Company, Cincinnati, Ohio

[21] Appl. No.: 438,939

[22] Filed: May 10, 1995

Related U.S. Application Data

[63] Continuation-in-part of Ser. No. 330,633, Oct. 28, 1994, abandoned.

[51] Int. Cl.[6] ..... C11D 1/75; C11D 1/40

[52] U.S. Cl. ..... 510/214; 510/244; 510/433; 510/499; 510/503

[58] Field of Search ..... 252/547, 544, 252/548, DIG. 14, 106; 510/214, 244, 433, 499, 503

[56] References Cited

U.S. PATENT DOCUMENTS

| | | | |
|---|---|---|---|
| 3,223,647 | 12/1965 | Drew | 252/137 |
| 3,943,234 | 3/1976 | Roggenkamp | 424/343 |
| 3,970,594 | 7/1976 | Claybaugh | 252/524 |
| 3,979,339 | 9/1976 | Claybaugh | 252/524 |
| 4,065,409 | 12/1977 | Flanagan | 252/528 |
| 4,165,334 | 8/1979 | Gosselink et al. | 260/458 |
| 4,276,205 | 6/1981 | Ferry | 252/528 |
| 4,391,726 | 7/1983 | Koster | 252/99 |
| 4,397,226 | 8/1983 | Ward | 252/527 |
| 4,397,776 | 8/1983 | Ward | 252/527 |
| 4,606,850 | 8/1986 | Malik | 252/528 |
| 4,690,779 | 9/1987 | Baker et al. | 252/546 |
| 4,820,436 | 4/1989 | Andres et al. | 252/544 |
| 5,108,660 | 4/1992 | Michael | 252/545 |
| 5,330,674 | 7/1994 | Urfer et al. | 252/176.17 |
| 5,376,310 | 12/1994 | Cripe et al. | 252/548 |
| 5,378,409 | 1/1995 | Ofosu-Asante | 252/548 |

FOREIGN PATENT DOCUMENTS

| | | | |
|---|---|---|---|
| 0 255 978 | 7/1987 | European Pat. Off. . | |
| 621335 | 10/1994 | European Pat. Off. . | |
| 38 897 | 3/1982 | Japan . | |
| 2 123 847 | 2/1984 | United Kingdom | C11D 1/83 |
| 2123847 | 2/1984 | United Kingdom . | |
| 6 157 | 9/1991 | WIPO | C11D 1/65 |
| 6157 | 4/1992 | WIPO . | |
| 22996 | 10/1994 | WIPO . | |

OTHER PUBLICATIONS

T. W. Graham Solomons, Organic Chemistry, 1984 pp. 70–71, 837.

Hodgman, Charles et al., Handbook of Chemistry and Physics, 1956 38th Edition, p. 1642.

Co–pending application Serial #08/115,294 ABD.

*Primary Examiner*—Margaret Einsmann

*Assistant Examiner*—John R. Hardee

*Attorney, Agent, or Firm*—Rose Ann Dabek; Daniel F. Nesbitt; Jacobus C. Rasser

[57] ABSTRACT

Disclosed are hard surface cleaning compositions comprising a) from about 1% to about 60% of an amine oxide detergent surfactant, b) an aqueous carrier liquid, and c) a protonated amine. When used to clean a vinyl surface, these compositions cause minimal or no staining of the vinyl surface.

8 Claims, No Drawings

HARD SURFACE CLEANING COMPOSITIONS COMPRISING PROTONATED AMINES AND AMINE OXIDE SURFACTANTS

CROSS REFERENCE TO RELATED APPLICATION

This is a continuation-in-part of U.S. patent application Ser. No. 08,330,633, filed Oct. 28, 1994, now abandoned.

FIELD

The present invention relates to no-rinse hard surface cleaners. More specifically, the present invention relates to mildly acidic to alkaline no-rinse hard surface cleaners which comprise an amine oxide detergent surfactant and a protonated amine.

BACKGROUND

The use of amine oxide detergent surfactants in cleaning compositions is well known. Amine oxides are most commonly used as cosurfactants to boost and maintain suds formation in laundry, shampoo, and dishwashing detergent compositions. Amine oxides have occasionally been used in hard surface cleaners such as acidic toilet bowl cleaners (pH of 2 or less), dishwashing liquids containing occlusive emollients (pH of 4 to 6.9), and selected non-acidic (neutral to alkaline) hard surface cleaners. In non-acidic hard surface cleaners, amine oxide detergent surfactants are essentially non-ionic ($pK_a$ between about 4 and about 6). These non-ionic amine oxides provide good cleaning properties and leave little or no visible residue on hard surfaces when they dry.

It was subsequently discovered that non-acidic hard surface cleaners containing amine oxides unfortunately stain or discolor vinyl (e.g., polyvinyl chloride) surfaces. The staining amounts to a light yellow to dark brown discoloration of the vinyl. Staining will also occur on waxed vinyl surfaces where areas of wax are worn thin or are chipped away so that the amine oxide can come in direct contact with the vinyl.

Based on the foregoing, there is a need for a hard surface cleaner having the cleaning properties of an amine oxide yet not cause staining of vinyl surfaces.

It is therefore an object of the present invention to provide a hard surface cleaning composition comprising an amine oxide detergent surfactant, yet causes minimal or no staining of vinyl. It is also an object of the present invention to provide such a composition which will have superior cleaning properties and will not leave a visible residue on cleaned surfaces. It is also an object of the present invention to provide a process for cleaning vinyl surfaces using such a composition.

These and other objects of the present invention will become evident to those skilled in the art from a reading of the present disclosure with the appended claims.

SUMMARY

The present invention is directed to a hard surface cleaning composition comprising a) from about 1% to about 50% of an amine oxide detergent surfactant, b) an aqueous carrier liquid, and c) a protonated amine. Such a composition satisfies the need for a hard surface cleaning composition having the beneficial cleaning properties of an amine oxide detergent surfactant, yet causes minimal or no staining of vinyl.

DETAILED DESCRIPTION

The following is a list of definitions for terms used herein.

"Comprising" means that other steps and other ingredients which do not affect the end result can be added. This term encompasses the terms "consisting of" and "consisting essentially of".

"Liquid compositions" means the mildly acidic to alkaline liquid hard surface cleaning composition of the present invention, or aqueous dilutions thereof.

"Non-liquid" means granular, powder or gel formulations which can be diluted with the aqueous carrier liquid described hereinafter to produce the hard surface cleaning composition.

"Vinyl" means material or surfaces containing polyvinyl chloride ("PVC"). Such material or surfaces can be waxed or unwaxed.

All pH values herein are measured in aqueous systems at 25° C. (77° F.). The compositions of the present invention preferably have a pH of from about 5 to about 14, more preferably from about 6 to about 12, more preferably still from about 7 to about 10.

All percentages are by weight of total composition unless specifically stated otherwise.

All ratios are weight ratios unless specifically stated otherwise.

The present invention, in its product and process aspects, is described in detail as follows.

Amine Oxide Detergent Surfactant

The compositions preferably comprise from about 1% to about 60% of an amine oxide detergent surfactant; more preferably from about 2% to about 50%; more preferably from about 2.5% to about 40%. The amine oxide preferably has the formula $R^1R^2R^3NO$, where $R^1$ is a substituted or unsubstituted alkyl or alkene group preferably containing from about 8 to about 30 carbon atoms; more preferably from about 8 to about 18. Groups $R^2$ and $R^3$ are each substituted or unsubstituted alkyl or alkene groups preferably containing from about 1 to about 18 carbon atoms; more preferably from about 1 to about 4.

More preferably, $R^2$ and $R^3$ are each methyl groups; examples of such amine oxides include dodecyldimethyl amine oxides, tetradecyldimethyl amine oxides, hexadecyldimethyl amine oxides, octadecyldimethyl amine oxides, and coconutalkyldimethyl amine oxides.

The amine oxide detergent surfactant can be prepared by known and conventional methods. One such method involves the oxidation of tertiary amines in the manner set forth in U.S. Pat. No. 3,223,647 and British Patent 43,566. In general terms, amine oxides are prepared by the controlled oxidation of the corresponding tertiary amines.

Examples of suitable amine oxide detergent surfactants for use in the hard surface cleaning composition include:

dodecyldimethyl amine oxide
tridecyldimethyl amine oxide
tetradecyldimethyl amine oxide
pentadecyldimethyl amine oxide
hexadecyldimmethyl amine oxide
heptadecyldimethyl amine oxide
octadecyldimethyl amine oxide
docecyldiethyl amine oxide
tetradecyldimethyl amine oxide
hexadecyldiethyl amine oxide
octadecyldiethyl amine oxide
dodecyldipropyl amine oxide
tetradecyldipropyl amine oxide hexadecyldipropyl amine oxide
octadecyldipropyl amine oxide
dodecyldibutyl amine oxide
tetradecyldibutyl amine oxide
hexadecyldibutyl amine oxide
octadecyldibutyl amine oxide
dodocylmethylethyl amine oxide
tetradecylethyl amine oxide
tetradecylethylpropyl amine oxide
hexadecylpropylbutyl amine oxide
octadecylmethylbutyl amine oxide Also useful are the amine oxide detergent surfactants which are prepared by the oxidation of tertiary amines prepared from mixed alcohols obtainable from coconut oil. Such coconutalkyl amine oxides are preferred from an economic standpoint inasmuch as it is not necessary for the present purposes, to separate the mixed alcohol fractions into their pure components to secure the pure chain length fractions of the amine oxides.

Protonated Amine

It was found that amine oxide staining of vinyl surfaces can be reduced or eliminated by including a protonated amine in the amine oxide containing composition.

The vinyl staining described herein comes from the dehydrochlorination of polyvinyl chloride. Without being bound by theory, it is believed that this dehydrochlorination reaction is accelerated by nonacidic amine oxide compositions. This accelerated dehydrochlorination is represented by the following reaction formula:

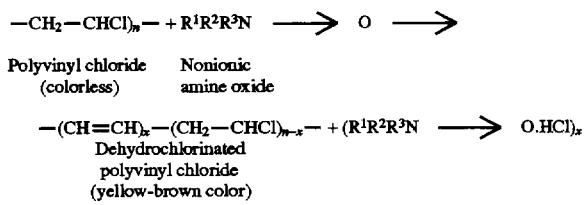

Dehydrochlorinated polyvinyl chloride has a yellow to brown appearance, depending on the degree of double bond (—CH=CH—) formation. Without being bound by theory, this dehydrochlorination is believed to be initiated by nonionic amine oxides as depicted in the above reaction formula.

It has been discovered that if the amine oxide is protonated before it comes in contact with the polyvinyl chloride, it will greatly reduce the rate of the dehydrochlorination reaction. E.g.,

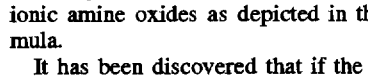

Consequently, vinyl staining is significantly reduced or eliminated.

One method of protonating the amine oxide is by acidifying the solution such that between 90% and 100% of the amine oxide within the liquid composition is protonated. (See, for example, copending U.S. patent application Ser. No. 08/115,294, filed Sep. 1, 1993; incorporated herein by reference). Since the amine oxides typically have $pK_a$'s of from about 4 to about 6, this approach requires an acidic formulation.

However, in certain instances, the user desires a relatively less acidic to basic formulation (e.g., pH 5–12). It has been discovered that less acidic to basic solutions can be formulated to obtain the advantages of more acidic, protonated amine oxide-containing formulations. In this alternative approach, the amine oxide is essentially "protonated" by ion pairing it with a protonated amine. By hydrogen bonding a protonated amine with the amine oxide, the rate of dehydrochlorination is greatly reduced and vinyl staining is thereby reduced or eliminated. The protonated amines form ion pairs with the amine oxides. Without being bound by theory, the species believed to be formed is as follows:

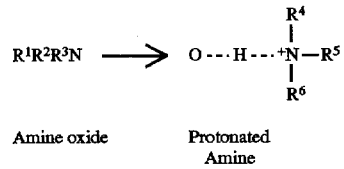

These ion pairs are much less reactive in dehydrochlorination reactions and do not penetrate vinyl surfaces as readily as non-ionic amine oxide species. Furthermore, formation of such ion pairs does not require an acidic formulation.

Any amine capable of being protonated is useful in the composition. Preferably the amine is a protonated primary, secondary or tertiary amine. From a cost standpoint, the most preferred are ammonium hydroxide and protonated monoethanolamine.

Preferably, a sufficient quantity of protonated amine is included in the composition to allow formation of at least about 0.1:1, more preferably from about 0.1:1 to about 2:1, molar ratio ("target molar ratio") of protonated amine to amine oxide. More preferably, the target molar ratio is from about 0.5:1 to about 1.5 to 1, more preferably still from about 0.9:1.2 to about 1:1.1, most preferably about 1:1. Achieving the target molar ratio is critical for minimizing or eliminating the staining of vinyl. Preferred protonated amines for use in the composition are based on the desired pH of the composition. Preferably a protonated amine having a $pK_a$ of about 1.5 units above the desired pH of the composition is used. Such a $pK_a$ will minimize the amount of protonated amine necessary to achieve the target molar ratio.

The following non-limiting discussion illustrates the selection and formula level of protonated amine that will maintain a 1:1 molar ratio with a selected amine oxide. If the desired formula pH is 8.0, then the amine should preferably have a $pK_a$ of about 9.5. However, protonated amines with lower $p_{Ka}$'s can be used as long as the concentration of amine is adjusted to maintain the 1:1 molar ratio. For example, monoethanolamine ("MEA") has a $pK_a$ of 9.44. Therefore, at pH 8.0 it is 96% protonated:

$$\% \text{ MEA-H}^+ = [H^+]/(K_a + [H^+])$$

$$\% \text{ MEA-H}^+ = (10^{-8})/(10^{-9.44} + 10^{-8}) = 0.96 \text{ or } 96\% \text{ protonated at pH } 8.0$$

A formula containing 9% lauryldimethylamine oxide (MW of 229) would need 2.5% MEA (MW of 61) to maintain a 1:1 molar ratio between MEA-$H^+$ and laurylmethylamine oxide at pH 8.0:

$$(9\% \text{ amine oxide}/229)\cdot(61)/(0.96) = 2.5\% \text{ MEA}$$

MEA can be used in a more alkaline formula to prevent staining as long as the concentration of MEA is increased to maintain the 1:1 molar ratio with the amine oxide. For example, at a formula pH of 9.0, the MEA level of the composition must be increased to 3.28% to prevent vinyl staining:

$$\% \text{ MEA-H}^+ = (10^{-9})/(10^{-9.44} + 10^{-9}) = 0.73 \text{ or } 73\% \text{ protonated at pH } 9.0$$

$$(9\% \text{ amine oxide}/229) \cdot (61)/(0.73) = 3.28\% \text{ MEA}$$

Clearly, one can use essentially any protonated amine in the composition. However, should one use a protonated amine having a $pK_a$ less than about 1.5 units greater than the desired pH of the composition, one will need to use relatively more protonated amine to achieve the target molar ratio of protonated amine to amine oxide.

Preferably the composition has a pH of from about 5 to about 14, more preferably from about 6 to about 12, more preferably from about 7 to about 10.

Preferably the amine has a $pK_a$ of from about 6.5 to about 14, more preferably from about 7.5 to about 10.5.

Aqueous Carrier Liquid

The compositions herein are employed on hard surfaces in liquid form. Accordingly, the foregoing components are admixed with an aqueous carrier liquid. The choice of aqueous carrier liquid is not critical. It must be safe and it must be chemically compatible with the components of the compositions.

The aqueous carrier liquid can comprise solvents commonly used in hard surface cleaning compositions. Such solvents must be compatible with the components of the composition and must be chemically stable at the desired pH of the composition. They should also have good filming/residue properties. Solvents for use in hard surface cleaners are described, for example in U.S. Pat. No. 5,108,660.

Preferably, the aqueous carrier liquid is water or a miscible mixture of alcohol and water. Water-alcohol mixtures are preferred inasmuch as the alcohol can aid in the dispersion and dissolution of the amine oxide and other materials in the compositions. The alcohols are preferably $C_2$–$C_4$ alcohols. Ethanol is most preferred.

Most preferably, the aqueous carrier liquid is water or a water-ethanol mixture containing from about 0% to about 50% ethanol. From about 40% to about 98.9% aqueous liquid carrier is used.

Non-liquid Formulation

The present invention also embodies a non-liquid composition from which the liquid hard surface cleaning compositions can easily be obtained by adding an aqueous carrier liquid. The non-liquid compositions can be in granular, powder or gel forms; preferably granular forms.

The non-liquid compositions also comprise a protonated amine, as described herein. The non-liquid compositions comprise enough of the protonated amine to provide, upon dilution with the aqueous carrier liquid, a pH and percent amine oxide and protonated amine complex within the ranges described herein for the liquid compositions.

The non-liquid gel compositions contain reduced amounts of the non-aqueous carrier liquid. The non-liquid granular compositions contain substantially no aqueous carrier liquid. In either form, an aqueous carrier liquid is added to the non-liquid composition prior to use to form the liquid hard surface cleaning composition. hard surface cleaning composition.

Auxiliary Materials

Optionally, the compositions herein can contain auxiliary materials which augment cleaning and aesthetics.

The compositions can optionally comprise a non-interfering auxiliary surfactant in addition to the amine oxide detergent surfactant. Additional auxiliary surfactants can effect cleaning activity. A wide variety of organic, water soluble surfactants can optionally be employed. The choice of auxiliary surfactant depends on the desires of the user with regard to the intended purpose of the compositions and the commercial availability of the surfactant.

The compositions can contain any of the anionic, nonionic and zwitterionic/amphoteric surfactants commonly employed in liquid hard surface cleaning compositions.

Examples of compatible auxiliary surfactants useful in the compositions are set forth below. The term "alkyl" used to describe these various surfactants encompasses the hydrocarbyl alkyl groups having a chain length of from about $C_8$ to $C_{22}$, i.e., materials of the type generally recognized for use as detergents. Suitable surfactants which can be employed in the compositions herein include anionic surfactants such as the alkyl sulfates, alkyl benzene sulfonates, olefin sulfonates, fatty acyl isethionates and taurides, alkyl sulfoccinates, alkyl ether sulfates ($AE_2SO_4$) and many others.

Examples of suitable nonionic surfactants include the polyethoxysorbitan esters, fatty acyl mono- and di-ethanol amides, $C_8$–$C_{22}$ ethoxylates and mixed coconut ethoxylates containing 1 to 30 ethoxylate groups.

Examples of suitable zwitterionic surfactants include the fatty alkyl betaines and sulfobetaines and similar compounds such as $C_8$ to $C_{18}$ ammonio propane sulfonate and $C_8$ to $C_{18}$ hydroxy ammonio propane sulfonates.

The anionic surfactants can be in the form of their water soluble salts, for instance the amine, ammonium, alkanolammonium or alkali metal salts. For most purposes it is preferred to use the anionic materials in their acid form to reduce the amount of auxiliary acid needed to acidify the composition. Especially preferred anionic surfactants herein are alkyl benzene sulfates and sulfonates; the alkyl ether sulfates of the general formula $AE_xSO_4$ wherein A=$C_{10}$–$C'_{22}$ alkyl, E is ethylene oxide, and wherein x is an integer from 0 to 30; the $C_{10}$–$C_{14}$ olefin sulfonates; and mixtures thereof.

Optionally, and preferably, the compositions contain water miscible substances having disinfectants properties. Preferred disinfectants are quaternary ammonium compounds, which are well known in the detergency art. Examples of suitable quaternary ammonium disinfectants include didecyl dimethyl ammonium chloride, N-alkyl ($C_{12}$ to $C_{18}$) dimethyl ammonium chloride, and N-alkyl ($C_{12}$ to $C_{18}$) dimethyl ethyl benzyl ammonium chloride.

Other optional additives such as perfumes, brighteners, enzymes, colorants, and the like can be employed in the compositions to enhance aesthetics and/or cleaning performance. These additives must be compatible with the active components in the composition, and they should not interfere with the inhibition of vinyl staining provided by the compositions.

Detergent builders can also be employed in the compositions. These builders are especially useful when auxiliary surfactants or cosurfactants are employed, and are even more useful when the compositions are diluted prior to use with exceptionally hard tap water., e.g., above about 12 grains. Detergent builders sequester calcium and magnesium hardness ions that might otherwise bind with and render less effective the auxiliary surfactants or cosurfactants. The detergent builders can be employed in the compositions at concentrations of between about 0% and about 10%.

Suds suppressors are especially useful in the composition. In the hard surface cleaning composition herein, suds formation and maintenance are undesirably promoted by the amine oxide component. The compositions therefore preferably comprise a sufficient amount of a suds suppressor to prevent excessive sudsing during employment of the compositions on hard surfaces. Suds suppressors are especially useful to allow for no-rinse application of the composition.

The suds suppressor can be provided by known and conventional means. Selection of the suds suppressor depends on its ability to formulate in the compositions, and the residue and cleaning profile of the compositions. The suds suppressor must be chemically compatible with the components in the compositions, it must be functional at the pH range described herein, and it should not leave a visible residue on cleaned surfaces.

Low-foaming cosurfactants can be used as suds suppressor to mediate the suds profile in the compositions. Cosurfactant concentrations between about 1% and about 3% are normally sufficient. Examples of suitable cosurfactants for use herein include block copolymers (e.g., Pluronic® and Tetronic®, both available from BASF Company) and alkoxylated (e.g., ethoxylated/propoxylated) primary and secondary alcohols (e.g., Tergitol®, available from Union Carbide; Poly-Tergent®, available from Olin Corporation).

The optional suds suppressor preferably comprises a silicone-based material. These materials are effective as suds suppressors at very low concentrations. The compositions preferably comprise from about 0.01% to about 0.50%, more preferably from about 0.01% to about 0.3%, of the silicone-based suds suppressor. At these low concentrations, the silicone-based suds suppressor is less likely to interfere with the cleaning performance of the compositions. Examples of suitable silicone-based suds suppressors for use in the compositions include Dow Corning® AF-2210 and Dow Corning® AF-GPC, both available from Dow Corning Corporation.

These optional but preferred silicone-based suds suppressors can be incorporated into the composition by known and conventional means. Such materials are typically water insoluble and require suspension in the aqueous environment of the compositions. The silicone-based suds suppressors are typically suspended by either increasing the viscosity of the liquid compositions or by matching the specific gravity of the compositions with that of the silicone-based suds suppressor. The specific gravity of the compositions can be increased to that of the silicone-based suds suppressor, for example, by adding a low level of a cosurfactant. A preferred cosurfactant for this purpose are betaine zwitterionic surfactants, preferably at concentrations of from about 0.5% to about 3%.

Method of Use

The present invention has been fully set forth in its composition aspects. The invention also encompasses a method for cleaning vinyl surfaces (waxed or unwaxed).

The method comprises applying to a vinyl surface the mildly acidic to alkaline cleaning compositions herein or, preferably, applying an aqueous dilution thereof. The vinyl surface is then wiped with a porous material, e.g., cloth or mop, and allowed to dry.

In a preferred method, the liquid composition is first diluted with an aqueous liquid, preferably tap water. The diluted composition has a pH of from about 5 to about 14, preferably from about 6 to about 12, more preferably from about 7 to about 10; comprises from about 0.02% to about 0.2%, preferably from about 0.04% to about 0.1% amine oxide detergent surfactant described herein. Preferably, at least about 10% of the amine oxide species in the diluted composition is ion paired with a protonated amine, more preferably from about 50% to about 100%, more preferably still from about 90% to about 100%; most preferably 100%. The diluted composition is then applied to and wiped over (with a porous material) the vinyl surface and allowed to dry.

EXAMPLES

The following examples further describe and demonstrate the preferred embodiments within the scope of the present invention. The examples are given solely for the purpose of illustration, and are not to be construed as limitations of the present invention since many variations thereof are possible without departing from its spirit and scope.

EXAMPLE 1

This example sets forth the preparation and use of a hard surface cleaning composition. The following components are combined to form a composition having a pH of 8.0:

| COMPONENT | % BY WEIGHT |
|---|---|
| Coconut dimethyl amine oxide | 29.0 |
| Monoethanolamine | 2.5 |
| Dow Corning AF-GPC | 0.1 |
| Phosphoric acid | 1.7 |
| Hydrochloric acid | 3.9 |
| Dye/perfume | 0.8 |
| Water | q.s. to 100% |

The above composition is diluted 1:256 with water. Soiled vinyl tiling is cleaned with the diluted composition by wiping a mop soaked with the diluted composition across the surface of the vinyl tiling. The vinyl tiling is allowed to air dry. The composition provides excellent cleaning benefits, shine maintenance, and non-streaking. Furthermore, repeated cleaning of the vinyl tiling with this composition over an extended period of time results in minimal to no staining of the vinyl.

EXAMPLE 2

This example sets forth the preparation and use of a hard surface cleaning composition. The following components are combined to form a composition having a pH of 9.0:

| COMPONENT | % BY WEIGHT |
|---|---|
| Coconut dimethyl amine oxide | 29.0 |
| Monoethanolamine | 3.3 |
| Dow Corning AF-GPC | 0.1 |
| Phosphoric acid | 0.0 |
| Hydrochloric acid | 6.1 |
| Dye/perfume | 0.8 |
| Water | q.s. to 100% |

The above composition is diluted 1:128 with water. Soiled vinyl tiling is cleaned with the diluted composition by wiping a mop soaked with the diluted composition across the surface of the vinyl tiling. The vinyl tiling is allowed to air dry. The composition provides excellent cleaning benefits, shine maintenance, and non-streaking. Furthermore, repeated cleaning of the vinyl tiling with this composition over an extended period of time results in minimal to no staining of the vinyl.

EXAMPLE 3

This example sets forth the preparation and use of a hard surface cleaning composition. The following components are combined to form a composition having a pH of 10.0:

| COMPONENT | % BY WEIGHT |
|---|---|
| Coconut dimethyl amine oxide | 29.0 |
| t-Butyl amine ($pK_a$ = 10.83) | 3.3 |
| Dow Corning AF-GPC | 0.1 |

-continued

| COMPONENT | % BY WEIGHT |
|---|---|
| Phosphoric acid | 0.0 |
| Hydrochloric acid | 4.9 |
| Dye/perfume | 0.8 |
| Water | q.s to 100% |

The above composition is diluted 1:64 with water. Soiled vinyl tiling cleaned with the diluted composition by wiping a mop soaked with the diluted composition across the surface of the vinyl tiling. The vinyl tiling is allowed to air dry. The composition provides excellent cleaning benefits, shine maintenance, and non-streaking. Furthermore, repeated cleaning of the vinyl tiling with this composition over an extended period of time results in minimal to no staining of the vinyl.

All publications and patent applications mentioned hereinabove are hereby incorporated in their entirety by reference.

It is understood that the examples and embodiments described herein are for illustrative purposes only and that various modifications or changes in light thereof will be suggested to one skilled in the art and are to be included in the spirit and purview of this application and scope of the appended claims.

What is claimed is:

1. A hard surface cleaning composition, consisting essentially of:

a) from about 1% to about 60% of an amine oxide detergent surfactant having the formula $R^1R^2R^3NO$, wherein $R^1$ has from about 8 to about 30 carbon atoms, and $R^2$ and $R^3$ each individually has from about 1 to about 18 carbon atoms, b) an aqueous carrier liquid;

c) a protonated amine; and a suds suppressor; and wherein the protonated amine has a $pK_a$ of about 1.5 units above the pH of the composition and the molar ratio of protonated amine to amine oxide is at least 0.1:1.

2. The composition of claim 1, wherein the molar ratio of protonated amine to amine oxide detergent surfactant is from about 0.1:1 to about 2:1.

3. The composition of claim 2, wherein the molar ratio of protonated amine to amine oxide detergent surfactant is about 1:1.

4. The composition of claim 1, wherein the pH of the composition is from about 6 to about 12.

5. The composition of claim 4, wherein the pH of the composition is from about 7 to about 10.

6. The composition of claim 1, wherein the amine oxide detergent surfactant has the formula $R^1R^2R^3NO$, where $R^1$ contains from about 8 to about 18 carbon atoms, and $R^2$ and $R^3$ each contain from about 1 to about 4 carbon atoms.

7. The composition of claim 6, wherein the composition comprises from about 2.5% to about 40% of the amine oxide detergent surfactant.

8. The composition of claim 1, wherein the protonated amine is ammonium hydroxide or protonated monethanolamine.

* * * * *